United States Patent [19]

Russell

[11] 4,271,656

[45] Jun. 9, 1981

[54] ENVELOPE PROCESSING MACHINE

[75] Inventor: Robert J. Russell, Medford, N.J.

[73] Assignee: Mail-Ex Corporation, Skokie, Ill.

[21] Appl. No.: 78,920

[22] Filed: Sep. 26, 1979

[51] Int. Cl.[3] ..... B65B 43/30

[52] U.S. Cl. ..... 53/381 R; 53/386

[58] Field of Search ..... 53/386, 569, 381 R, 53/570, 492; 93/53 SD

[56] References Cited

U.S. PATENT DOCUMENTS

| | | | |
|---|---|---|---|
| 3,384,252 | 5/1968 | West | 53/381 R X |
| 3,566,578 | 3/1971 | Thorne et al. | 53/386 X |
| 3,594,981 | 7/1971 | Pitts | 53/386 |
| 3,783,752 | 1/1974 | Langen | 93/53 SD |
| 4,100,843 | 7/1978 | Dietrich | 93/53 SD X |
| 4,110,958 | 9/1978 | Stevens | 53/386 |
| 4,159,611 | 7/1979 | Russell | 53/381 R X |

*Primary Examiner*—John Sipos

*Attorney, Agent, or Firm*—Trexler, Wolters, Bushnell & Fosse, Ltd.

[57] ABSTRACT

There is disclosed a new and improved envelope processing machine. The machine includes a supply hopper for retaining a quantity of envelopes to be processed, an envelope processing station, means for removing envelopes from the supply hopper and for transmitting the removed envelopes to the envelope processing station, and envelope opening means at the processing station including a pair of reciprocating envelope gripping means arranged to grip and separate opposite panels of an envelope to facilitate the removal of the contents therefrom. The envelope gripping means include bending means for bending the envelope panels inwardly as the envelope panels are separated for displacing the envelope contents from the envelope panels towards the center of the opened envelope. As a result, the envelope contents are disposed within the opened envelopes in a position which enables convenient grasping of the contents by an operator.

8 Claims, 15 Drawing Figures

ENVELOPE PROCESSING MACHINE

BACKGROUND OF THE INVENTION

The present invention relates to a new and improved envelope processing machine.

Envelope processing machines are known in the prior art wherein the contents within envelopes are mechanically extracted from the envelopes. One such machine is described, for example, in West, U.S. Pat. No. 3,384,252. In such machines, envelopes are removed from a supply hopper, transmitted to a cutting station where one edge of the envelope is cut open, and then transmitted to a removal station wherein the envelope is opened and the contents mechanically extracted. The present invention provides for the manual removal or insertion of the contents of an envelope at the processing station, thus avoiding the complexity and problems incident to the operation of mechanical processing means.

Envelope processing machines are also known in the prior art wherein envelopes are removed from a supply hopper, severed along one edge at a cutting station, and transmitted to a station whereat the envelope is opened and held open for manual removal of the contents therefrom. Such a machine is fully described and claimed in U.S. Pat. No. 4,159,611 which is assigned to the assignee of the present invention. The machine there described includes a plurality of reciprocating arms with each such arm terminating with a suction cup coupled to a source of negative air pressure. One such arm is located at the envelope hopper where the suction cup engages the envelopes one at a time and pulls the envelopes to a conveyor. The suction cup is able to grip the envelopes due to the air suction at the suction cup. Similarly, a pair of such arms are located at the processing station with each arm having a suction cup arranged to engage respective side panels of the envelopes for gripping and separating the side panels to dispose the envelopes in an open condition to an operator. Again, the suction at the suction cups facilitates the gripping of the envelopes side panels.

While the last mentioned envelope processing machine has exhibited features and advantages over similar machines in the prior art, it is possible that a problem may be encountered at the processing station due to the air suction utilized for gripping and separating the side panels of the envelopes. When envelopes constructed from porous paper material are processed, the air suction utilized for opening the envelopes may pass through the envelope side panels and, as a consequence, hold the contents of the envelope against one of the side panels during the manual extraction process. If this situation should ensue, an operator would have difficulty removing all the contents from the envelope.

It is therefore a general object of the present invention to provide a new and improved envelope processing machine.

It is a further object of the present invention to provide an envelope processing machine which includes a new and improved envelope opening means which bends the side panels of the envelopes inwardly as the envelope panels are separated to thereby force the contents within the envelopes away from the side panels and towards the center of the opened envelopes to dispose the contents within the envelopes in a position to allow easy grasping of the contents by an operator.

The invention therefore provides an envelope processing machine which includes a supply hopper for envelopes to be processed, an envelope processing station, means for removing envelopes from the supply hopper and for transmitting the removed envelopes to the envelope processing station, an envelope opening means at the processing station which includes a pair of reciprocating envelope gripping means arranged to grip and separate opposite panels of an envelope to facilitate the removal of contents therefrom. At least one of the envelope gripping means includes envelope panel bending means for bending its respective envelope panel as the envelope panels are separated for displacing the envelope contents from the envelope panels.

BRIEF DESCRIPTION OF THE DRAWINGS

The features of the present invention which are believed to be novel are set forth with particularity in the appended claims. The invention, together with further objects and advantages thereof, may best be understood by making reference to the following description taken in conjunction with the accompanying drawings where, in the several figures like reference numerals identify identical elements, and wherein:

DESCRIPTION OF THE PREFERRED EMBODIMENTS

Figure 1:
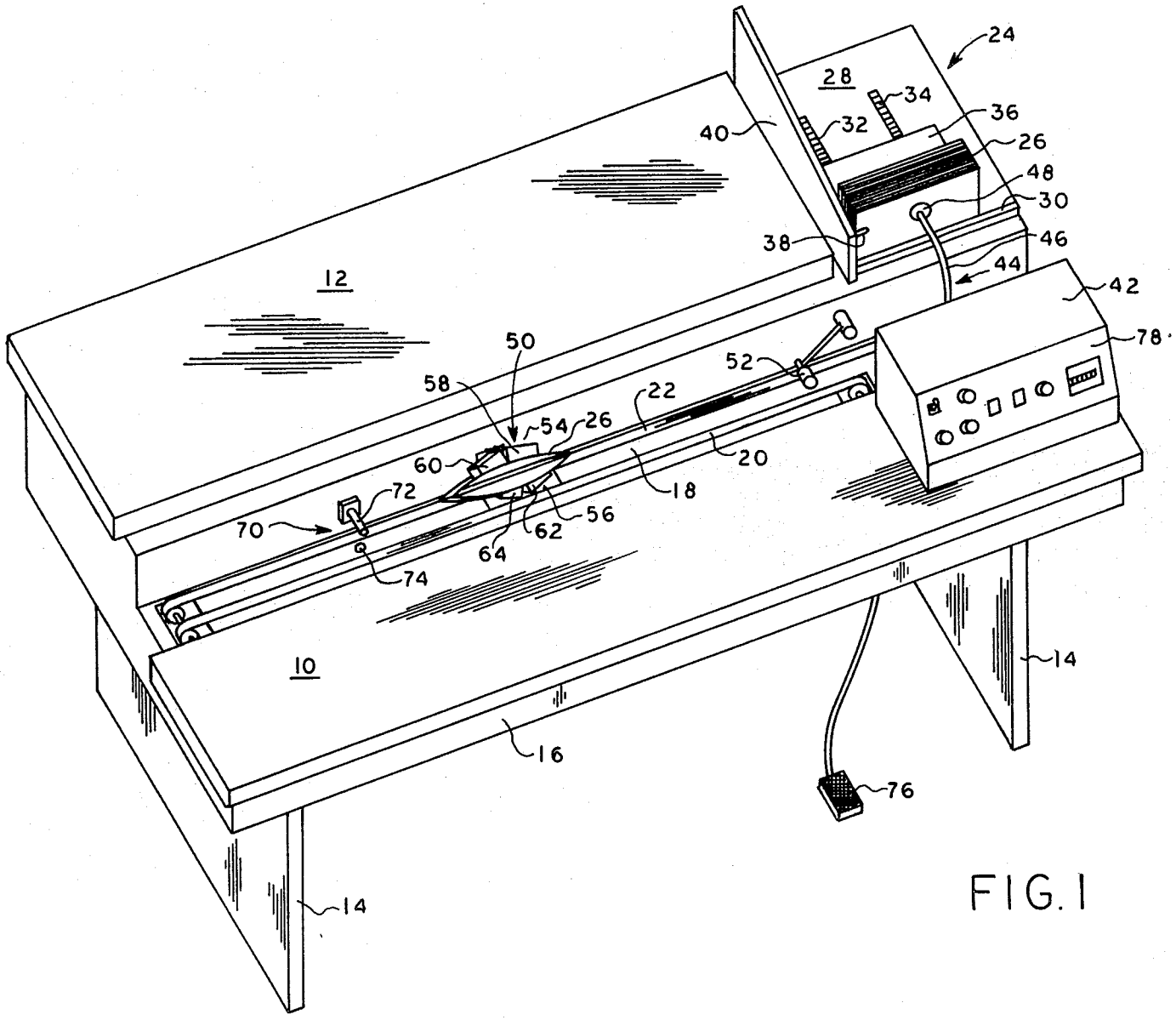
FIG. 1 is a general perspective view showing the machine of the present invention in accordance with one selected embodiment thereof.

Referring now to FIG. 1, the envelope processing machine there shown constructed in accordance with the present invention generally includes lower and upper offset table structures 10 and 12 supported at table height by legs 14. The upper table 12 covers the internal mechanism of the machine and conveniently provides a work and table surface. The operator sits facing the lower table surface 10 at the front panel of the machine indicated by the reference numeral 16. Between the upper table 12 and lower table 10 there is disposed a substantially horizontal plate 18 which extends across substantially the entire width of the machine. The plate 18 supports a pair of endless conveyor belts 20 and 22 which form an envelope transmitting means for conveying the envelopes to be processed from one station of the machine to the next in succession.

To the right of the upper table surface 12 there is provided a supply hopper 24 arranged to contain a plurality of envelopes 26 to be processed. The hopper 24 includes an inclined surface 28 having a lip portion 30, a pair of endless belts 32 and 34 arranged to travel along the surface 28, a weight block 36, and a retainer 38 which projects in the direction of the envelopes 26 from a side abutment plate 40. The envelopes 26 are arranged in stacked relation and held in that position against the abutment plate 40 by the coaction of the retainer 38, the lip portion 30 extending from the surface 28, and the weight block 36. Between the hopper 24 and the control box 42 of the machine there is provided a feed means 44 which includes a reciprocating arm 46 which terminates in a suction cup 48. The reciprocating arm 46 is connected to a source of negative air pressure (not shown) and transmits the air suction to the suction cup 48 to facilitate gripping of the envelopes 26 by the suction cup 48. The arm 46 is arranged to pivot from a retracted position whereat the suction cup 48 is beneath the plate 18 to the illustrated position in FIG. 1 for gripping the envelopes 26 one at a time and placing the envelopes onto the conveyor belts 20 and 22. A mechanism for causing the arm 46 to reciprocate as described is fully shown and described in the aforementioned U.S. Pat. No. 4,159,611. As the arm 46 pivots to its retracted position, the envelope gripped by the suction cup 48 is pulled free of the retainer 38 and lip 30 and downwardly to the conveyor. As the feed means 44 operates, the belts 32 and 34 travel along the inclined surface 28 and the weight 36 descends along the inclined surface 28 to provide a continuous supply of stacked envelopes 26 for the feed means 44.

After being placed onto the conveyor, the envelopes are transmitted to a cutting means (not shown) which is arranged to sever the envelopes along an edge thereof. As the envelopes are transferred to the cutter, they are oriented with respect to the cutter preferably in a manner fully described in the aforementioned U.S. Pat. No. 4,159,611 by a plurality of feed belts which are angularly disposed with respect to an abutment member. The feed belts cause the edge of the envelopes to be severed to engage the abutment member to properly orientate the envelopes with respect to the cutter.

Immediately after being severed by the envelope cutter, the envelopes are then conveyed by the belts 20 and 22 to the processing station 50 whereat the envelopes are opened and retained in an opened position to afford ready extraction of the contents thereof by an operator. In being so conveyed, the envelopes are caused to pass beneath a pressure roller 52 which assures firm engagement of the envelopes with the belts 20 and 22.

The envelope processing station 50 includes an envelope opening means comprising a pair of reciprocating envelope gripping means 54 and 56 which are arranged to grip and separate opposite panels of an envelope 26. As will be described in greater detail hereinafter, the gripping means 54 and 56 each include a pair of envelope panel seizing means 58, 60 and 62, 64, respectively. Each of the pair of seizing means are pivotally connected and arranged to grip their respective envelope panel at laterally spaced apart locations so that, as the opposed panels of the envelopes are separated, each respective pair of seizing means pivot toward each other to cause the envelope panels to in turn bend inwardly as the panels are separated for forcing the envelope contents away from the envelope panels towards the center of the opened envelopes.

After the envelope has been opened and its contents removed, the envelope is once again placed upon the belts 20 and 22 and conveyed to a detecting station 70 which detects the presence or absence of contents within an envelope. The detection station 70 includes a detector or candling mechanism comprising a light source 72 and a photocell 74. The light source 72 and photocell 74 are spaced apart for receiving the envelope therebetween. When the light reaching the photocell 74 from the light source 72 drops below a predetermined intensity, as for example when contents from an envelope have been overlooked or otherwise not removed, the machine remains stopped for so long as this condition exists. For a more complete description of such a detecting mechanism for use in such a machine as that shown in FIG. 1, reference may be had to the aforementioned U.S. Pat. No. 4,159,611. That patent may additionally be referred to for a complete description of an illustrative control circuitry which causes the machine to function in a properly timed sequence.

Lastly, it can be noted in FIG. 1 that a foot switch 76 is provided. The foot switch 76 allows an operator to conveniently actuate and deactuate the machine while in a sitting position and with the operator's hands unoccupied. The control panel 78, as fully described in the aforementioned referenced patent, may be utilized for establishing the machine in an automatic sequence whereby one press of the foot pedal 76 causes the machine to run and continuously present opened envelopes to the operator, one at a time in succession, for the removal of contents therefrom. Furthermore, the control panel 78 may be utilized to establish an operator controlled sequence of the machine so that each envelope may be incremented along to the processing station upon each depression of the foot pedal 76.

Referring now to FIGS. 5–8, there is shown a first preferred embodiment of envelope panel gripper 56. One such gripper 56 is illustrated in FIGS. 5–8 inasmuch as the other gripping means 54 is identical thereto.

The gripping means 56 includes a pair of housings 80 and 82. Each housing 80 and 82 includes a pair of interfitting and overlapping extensions 84, 88, 86, and 90. The overlapping extensions are joined together by a pin 92 which pivotally connects the housings 80 and 82 together.

Figure 7:
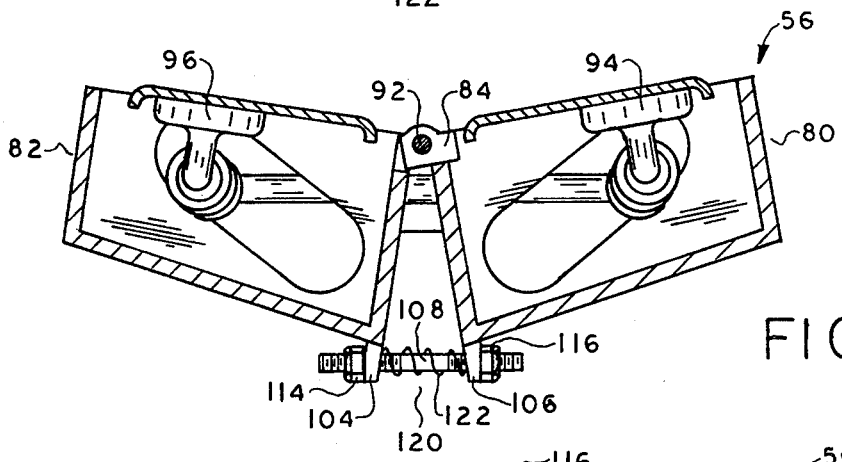
Figure 8:
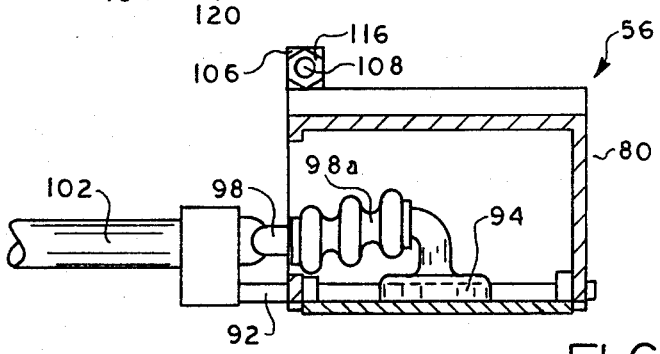
FIG. 8 is a side view, partly in section, of the gripping means of FIG. 5.
Figure 9:
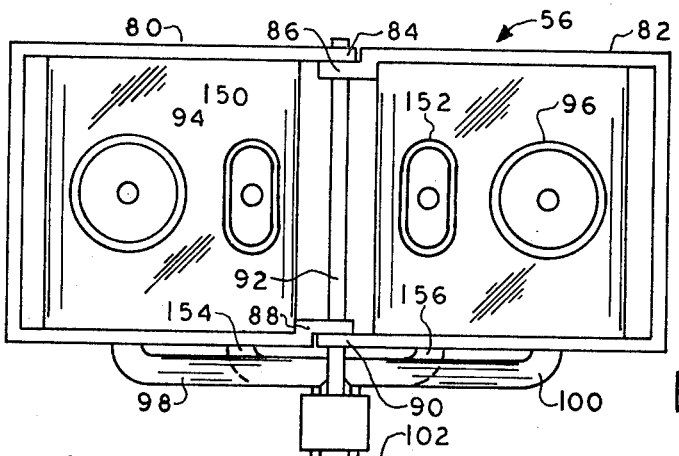
FIG. 9 is a top plan view of another gripping means embodying the present invention.
Figure 10:
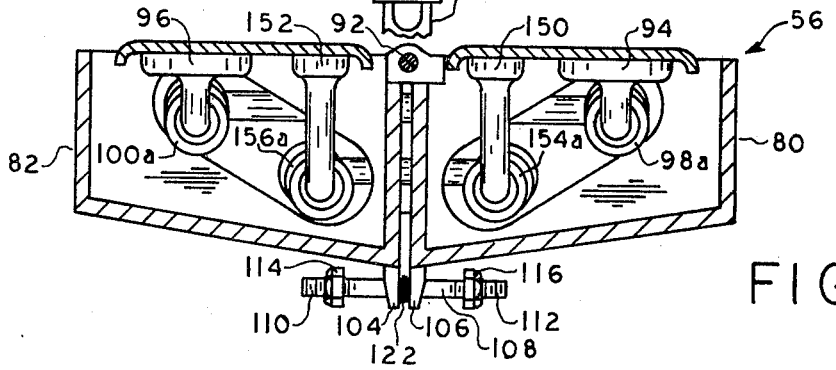
FIGS. 10 and 11 are front views, partly in section, illustrating the operation of the gripping means of FIG. 9.
Figure 11:
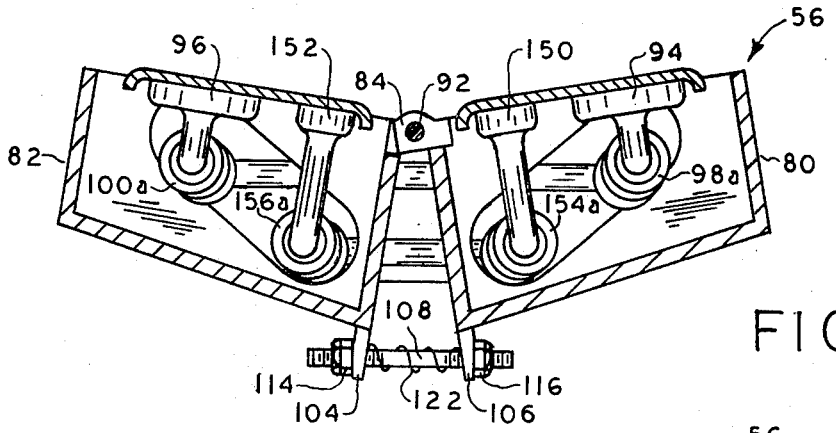
Figure 12:
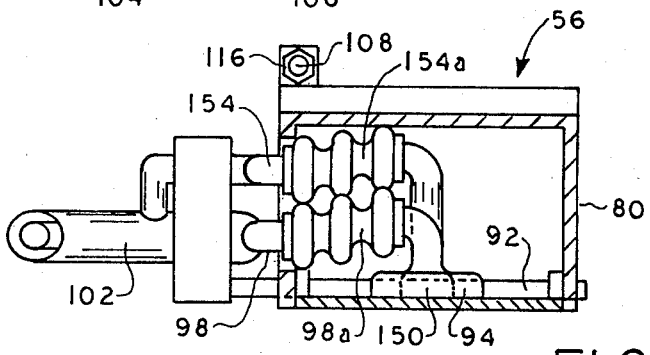
FIG. 12 is a side view, partly in section, of the gripping means of FIG. 9.

Each of the housings 80 and 82 includes a suction cup 94 and 96, respectively. The suction cups 94 and 96 are spaced apart and when employed in the machine of FIG. 1 seize their envelope side panel at laterally spaced apart locations. The suction cups 94 and 96 are coupled to a source of negative air pressure through flexible tubing 98 and 100 each including a bellows-like formation 98*a* and 100*a* to allow flexing of the tubing 98 and 100 when the housings 80 and 82 pivot toward one another to their relative position as illustrated in FIG. 7. As will be described subsequently, the housing 80 and 82 pivot toward one another about the connecting pin 92 as the envelope panels are separated at the processing station of the machine. The flexible tubing 98 and 100 are coupled to a reciprocating arm 102 which is internally hollow and coupled to the source of negative air pressure. As a result, the reciprocating arm 102 provides the air suction to the suction cups 94 and 96. The arm 102 is also coupled to the connecting pin 92 for carrying the gripping means 56.

The housings 80 and 82 also include flanges 104 and 106 with each flange 104 and 106 having a through bore which receives a pin member 108. The pin member 108 is threaded at its ends 110 and 112 for receiving suitably threaded nuts 114 and 116. As the results of the foregoing structure, a limit means is provided to the housings 80 and 82 which limits the degree of pivotal movement of the housings during envelope processing. As shown in FIG. 7, when the housings 80 and 82 are fully pivoted relative to one another, the flanges 104 and 106 engage the nuts 114 and 116 to thereby limit the pivoting of the housings 80 and 82.

Figure 6:
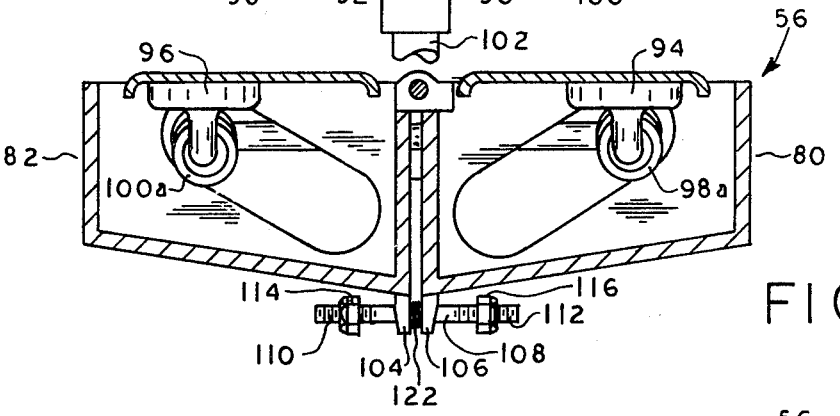
FIGS. 6 and 7 are front views, partly in section, illustrating the operation of the gripping means of FIG. 5.

To promote the pivotal movement of the housings 80 and 82 as the envelope panels are spread apart, the gripping means 56 further includes an urging means 120 in the form of a coil spring 122. The spring 122 is coaxially disposed about the pin member 108 between the flanges 104 and 106. In FIG. 6, the spring 122 is shown in its compressed state prior to the pivoting of the housings 80 and 82. As the spring 122 becomes uncompressed and expands, it forces the flanges 104 and 106 apart to thereby cause the housings 80 and 82 to pivot until the flanges 104 and 106 engage the nuts 114 and 116. As a result, the suction cups 96 and 94 are also caused to pivot.

Figure 2:
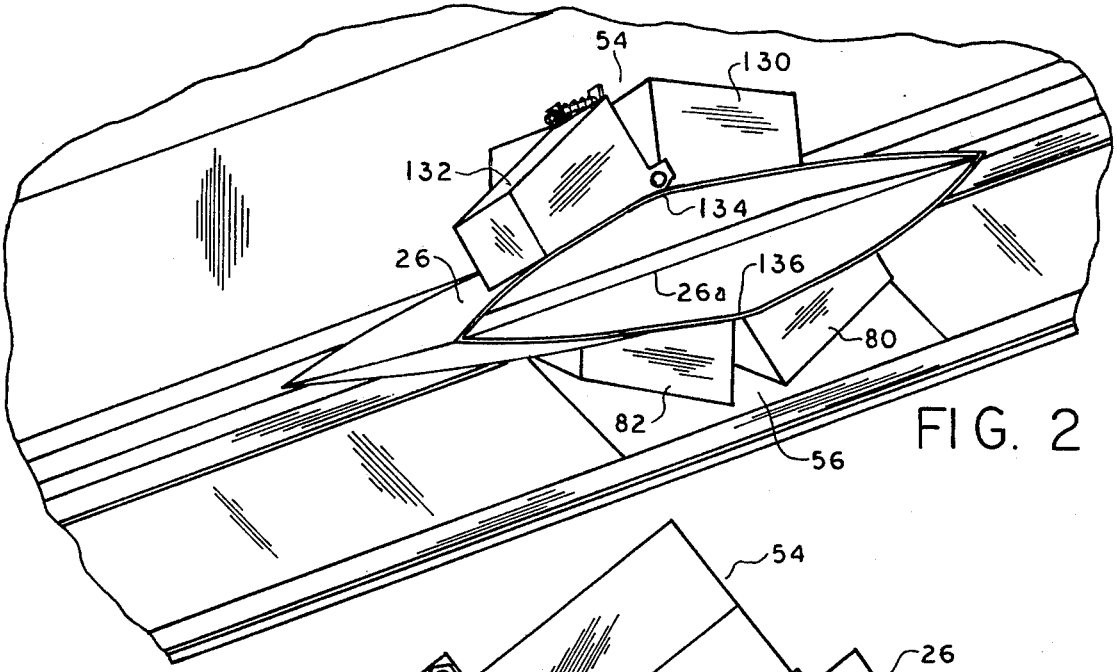
FIG. 2 is a partial perspective view of the machine, more particularly showing the manner in which the envelope opening means bends the side panels of the envelopes as they are separated for opening the envelopes in accordance with the present invention.

Referring now to FIG. 2, it can there be noted that when the panels of the envelope 26 are separated by the gripping means 54 and 56, the inwardly pivotal movement of the housings 80 and 82 of gripping means 56, and the housings 130 and 132 of gripping means 54 cause the envelope panels to bend at 134 and 136 proximate to the pivotal connection of the housings. As a result of the bending of the envelope panels, the contents **26*a* within the envelope 26 will be forced away from the inner surfaces of the envelope panels towards the center of the opened envelope. Hence, even though the gripping means 56 and 54 utilize suction cups, any amount of air suction which may be transmitted through the envelope panels will be broken as a result of the force exerted on the envelope contents 26*a*** in response to the bending of the envelope panels.

Figure 3:
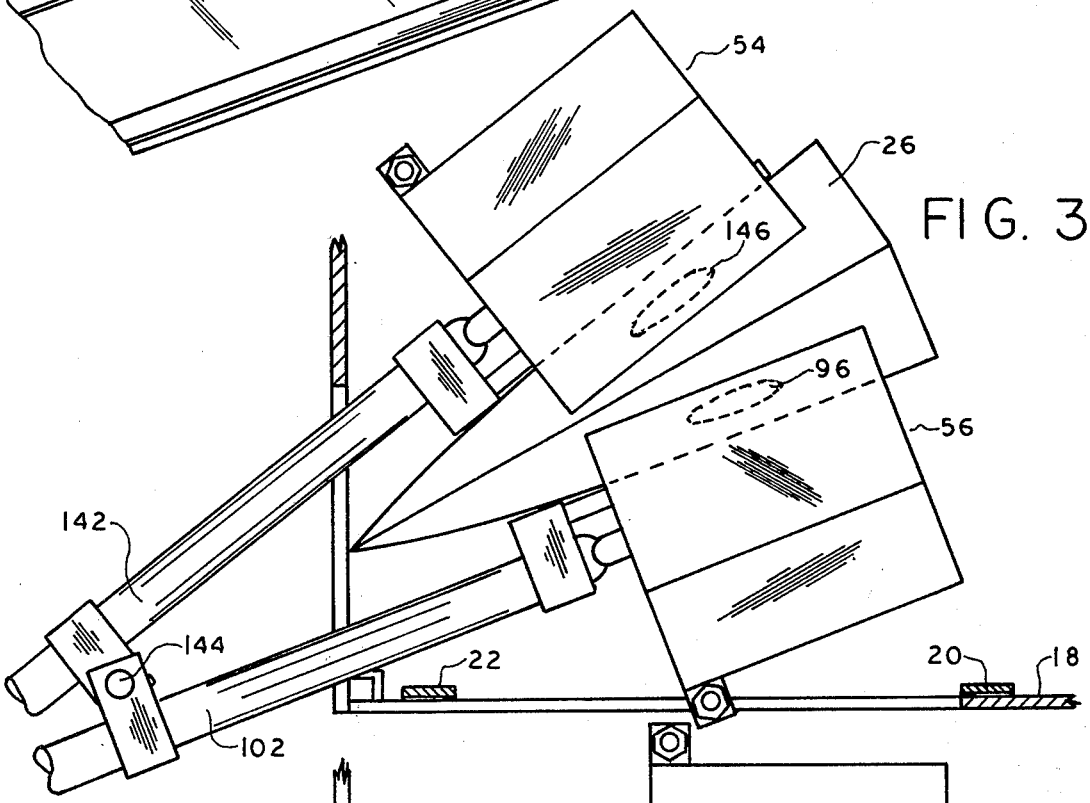
FIGS. 3 and 4 are partial diagrammatic side views of the envelope processing station of the machine of FIG. 1 illustrating the operation of the envelope opening means in accordance with the present invention.

In the side view of FIG. 3, it may be particularly noted that the reciprocating arms 102 and 142 which support the gripping means 56 and 54 are pivotally connected together by a pin 144. The ends of the arms 102 and 142 opposite the gripping means 56 and 54 may be operated upon by suitably contoured eccentric cams (not shown) to cause the reciprocal movement of the arms 102 and 142 and thus the gripping means 56 and 54 for separating the envelope panels. Such a cam mechanism is fully described in the aforementioned U.S. Pat. No. 4,159,611 and in co-pending application Ser. No. 48,992, filing date June 15, 1979, which is also assigned to the assignee of the present invention.

Figure 4:
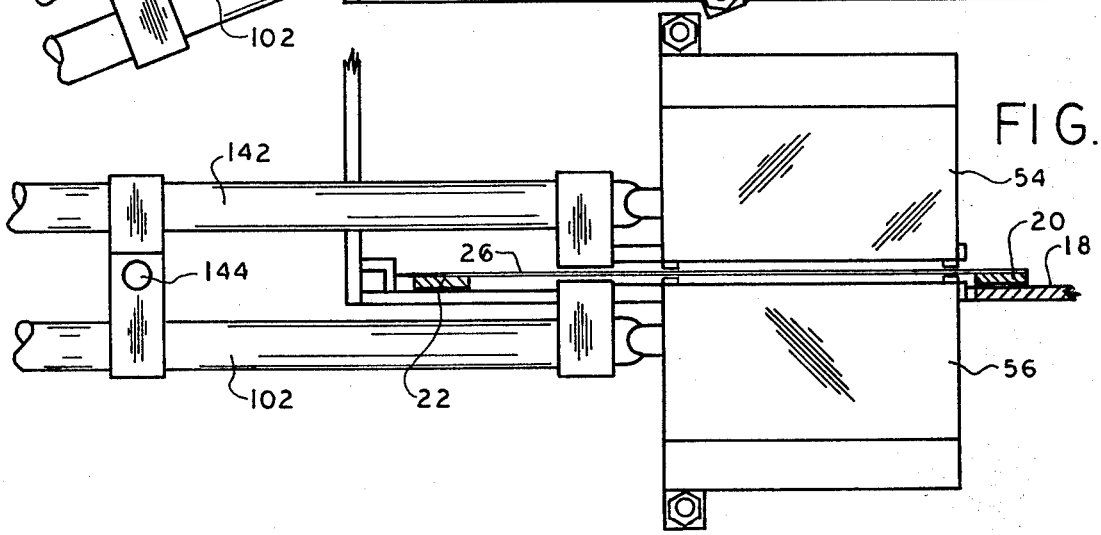
Figure 5:
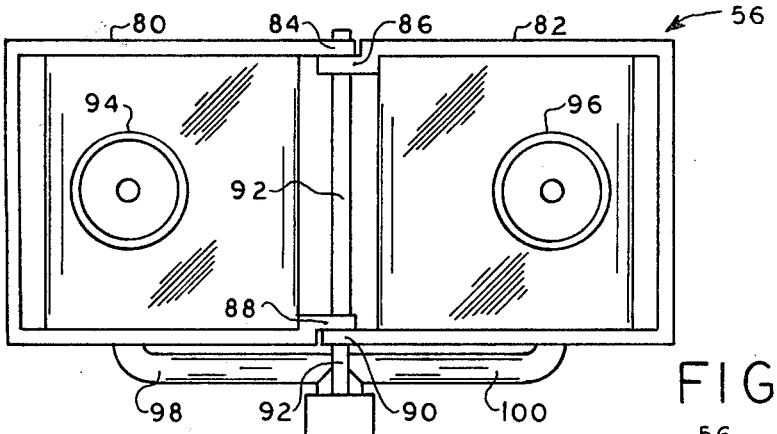
FIG. 5 is a top plan view of an envelope panel gripping means embodying the present invention.

As described in the aforementioned patent and co-pending patent application, when the envelope 26 arrives at the processing station, the reciprocating arms 102 and 142 are brought together as shown in FIG. 4 to allow the gripping means 56 and 54 to engage opposite panels of the envelope 26. Thereafter, the arms 142 and 102 are pivoted upwardly to the position shown in FIG. 3 with the arm 142 being pivoted to a greater extent than the arm 102 so that the opposing panels of the envelope 26 are separated. The panels of the envelope are firmly held by the suction cups of the gripping means 56 and 54 with two such suction cups 96 and 146 of gripping means 56 and 54 respectively being illustrated in dashed lines.

As the opposing panels of the envelope 26 are separated, the coiled springs of the gripping means cause the gripping means housings to pivot for bending the opposed panels of the envelopes as shown in FIG. 2. The housings of the gripping means will pivot until they reach their pivotal movement limits as previously described. For example, the pivotal movement of the housings may be limited to approximately 20° or any other degree of pivoting required so as to break any possible bond between the contents of the envelopes and the air suction provided by the gripping means.

Once the envelope has been opened and its contents removed, the arms 142 and 102 are returned to their position shown in FIG. 4, whereupon, the air suction applied to the arms and thus to the suction cups is terminated so that the envelope panels are released by the gripping means 56 and 54. Immediately thereafter, gripping means 56 is retracted further beneath the plate 18 of the conveyor and the gripping means 54 is raised above the envelope through the pivoting of arm 142. At this point in time, the processing station is ready to receive another envelope by the conveyor belts 20 and 22.

Referring now to FIGS. 9–12, there is shown a second embodiment of the gripping means 56. Like the embodiment of FIGS. 5–8, the gripping means 56 of FIGS. 9–12 includes the housings 80 and 82 which are pivotally connected together by the connecting pin 92, and the suction cups 94 and 96. The gripping means 56 is also connected to the reciprocating arm 102 by its connection to the connecting pin 92 and is also coupled to the suction cups 94 and 96 by the flexible tubing 98 and 100. The gripping means 56 also includes the pivot limit means including pin 108, flanges 104 and 106, and the nuts 114 and 116. The coil spring 122 is also provided between the flanges 104 and 106.

However, in addition to the foregoing, the gripping means 56 of FIGS. 9–12 further includes an air blower cup associated with each of the air suction cups 94 and 96. To that end, housing 80 contains the air blower cups 150 and housing 82 contains the air blower cup 152. The flexible tubing 154 and 156 also include the bellows-like configuration **154*a* and 156*a* to give the tubing further flexibility during the pivoting of the housings 80 and 82. The reciprocating arm 102 preferably includes a pair of air ducts or annular channels with one such channel being connected to a source of negative air pressure to be applied to the flexible tubing 98 and 100 for suction cups 94 and 96, while the other channel being coupled to a source of positive air pressure to be supplied to the flexible tubing 154 and 156 for the air blower cups 150 and 152. As a result of the foregoing, the air blower cups 150 and 152** comprise an air blowing means for blowing air through the envelope panels to further promote the displacement of the contents within the envelopes toward the center of the envelopes and away from the envelope side panels.

Figure 13:
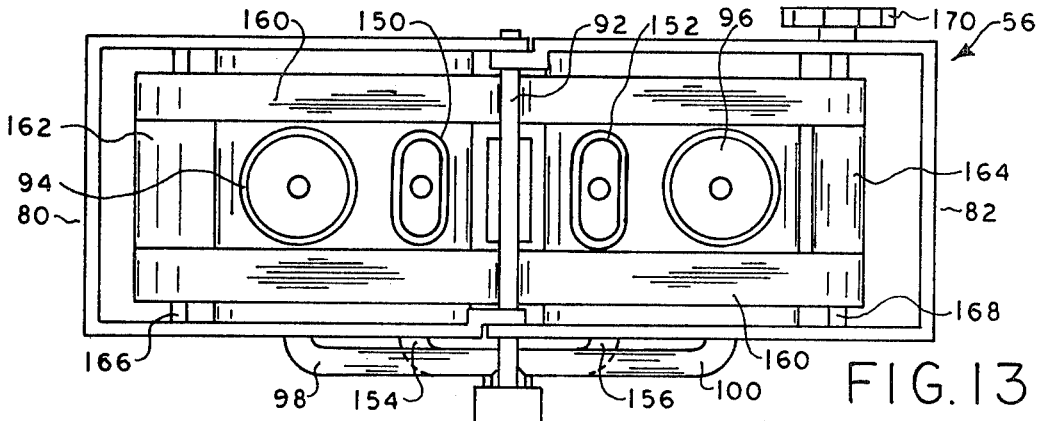
FIG. 13 is a top plan view of a further envelope panel gripping means embodying the present invention.
Figure 14:
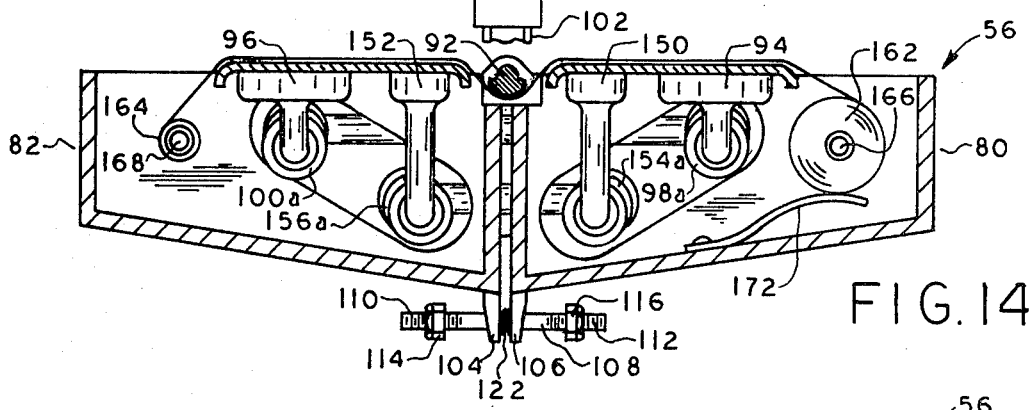
FIGS. 14 and 15 are front views partly in section illustrating the operation of the gripping means of FIG. 13.
Figure 15:
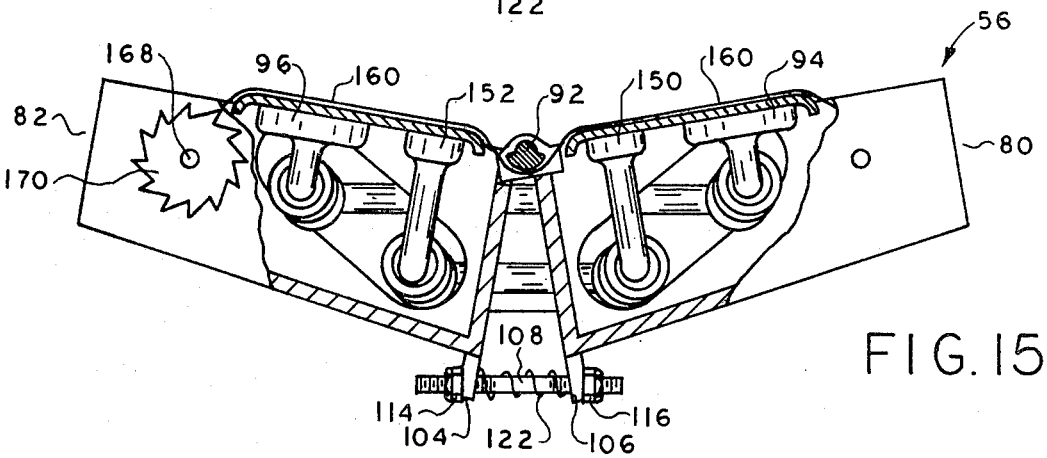

Referring now to FIGS. 13–15, there is shown a third embodiment of the gripping means 56. The gripping means 56 of FIGS. 13–15 is substantially identical to the gripping means of FIGS. 9–12 and therefore, a description of the elements which they have in common need not be repeated. In addition to the structural elements of the gripping means of FIGS. 9–12, the gripping means 56 of FIGS. 13–15 further includes a tacky adhesive webbing 160 which extends across the housings 80 and 82 on both sides of the suction cups 94 and 96 and air blower cups 150 and 152. The tacky adhesive web 160 is supplied by a supply pool 162 and extends across the housing 80, under the pivot connecting pin 92, across housing 82, and to take-up spool 164. The spools 162 and 164 are mounted on shafts 166 and 168 respectively, which extend across opposing sidewalls of the housings 80 and 82, respectively. As will be noted in FIG. 15, the take-up spool 164 is provided with a ratchet 170 externally of the housing which is also coupled to the shaft 168. As fully described in the co-pending patent application Ser. No. 48,992, filing date June 15, 1979, the ratchet 170 may be incrementally advanced during each operation of the gripping means 56 as it is retracted beneath the plate 18 of the machine to engage an incrementing projection which engages the ratchet 170 for causing the ratchet to increment. Similarly, the other gripping means 54 may be similarly structured as fully described in the aforementioned co-pending application.

The web 160 includes on its surface which engages the envelopes a tacky adhesive substance. The web, when engaging the envelopes along with the suction cups 96 and 94, further promotes the gripping or seizing of the envelope panels.

The operation of the gripping means illustrated in FIGS. 9–12 and the gripping means illustrated in FIGS. 13–15 in separating the opposing panels of the envelope and bending the panels to promote displacement of the contents in the envelopes away from the internal surfaces of the envelope panels is substantially identical to the operation of the gripping means illustrated in FIGS. 5–8 and as shown in FIGS. 2–4. In each case, the envelope panels are not only separated, but additionally, are bent proximate to the pivotal connection of the gripping means housings to cause the envelope contents to be displaced from the envelope side panels toward the center of the opened envelopes. In the embodiment of FIGS. 9–12, displacement of the contents is further promoted by the blowing cups 150 and 152, and in the embodiment of FIGS. 13–15, the gripping or seizing of the side panels of the envelope is further promoted by the tacky adhesive webbing 160 without of course, increasing the air suction applied to the envelope side panels.

While particular embodiments of the present invention have been shown and described, modifications may be made, and it is therefore intended to cover in the appended claims all such changes and modifications which fall within the true spirit and scope of the invention.

What I claim is:

1. An envelope processing machine comprising: a supply hopper for envelopes; an envelope processing station; means for removing envelopes from the supply hopper and for transmitting the removed envelopes to the envelope processing station; and envelope opening means at said processing station including a pair of envelope gripping means arranged for reciprocal movement to grip and separate opposite panels of an envelope to facilitate the removal of contents therefrom and each including envelope panel bending means with pivotally connected panel seizing means arranged to pivot toward each other as the envelope panels are separated for bending their respective envelope panel proximate to the pivotal connection of said seizing means; and said seizing means including air suction means for seizing the envelope side panels and blower means for blowing air through the envelope side panels to further promote displacement of the envelope contents from the envelope panels.

2. An envelope processing machine as defined in claim 1 wherein each said seizing means includes tack adhesive means for further assisting in the seizing of the opposite envelope panels.

3. An envelope processing machine as defined in claim 2 wherein said tacky adhesive means comprises a web having an adhesive on its surface which engages the envelope panels.

4. An envelope processing machine as defined in claim 3 wherein said tacky adhesive means further comprises supply means for incrementally providing a fresh supply of said adhesive web as said opening means acts upon successive envelopes.

5. An envelope processing machine as defined in claim 1 wherein each said gripping means includes a pair of spaced apart suction cups arranged to engage and grip their respective envelope panel at said spaced apart locations and arranged to pivot toward each other as the envelope panels are separated for bending their respective envelope panel inwardly.

6. An envelope processing machine as defined in claim 5 wherein each said gripping means further includes a pair of housings, each said housing containing a respective one of said suction cups, and said housing being pivotally joined together.

7. An envelope processing machine as defined in claim 6 wherein each said gripping means includes spring means between said housings for assisting in the pivoting of said housing as the envelope panels are separated.

8. An envelope processing machine as defined in claim 7 wherein each said gripping means includes means for limiting the extent of pivotal movement of said housings.

* * * * *